United States Patent [19]

Walls

[11] 4,328,964

[45] May 11, 1982

[54] MULTI-SPORT EXERCISER

[76] Inventor: Thomas J. Walls, 2103 May Ave., Muncie, Ind. 47302

[21] Appl. No.: 74,224

[22] Filed: Sep. 10, 1979

[51] Int. Cl.[3] ..... A63B 21/04

[52] U.S. Cl. ..... 272/136; 272/142; 272/143; 272/900; 273/29 A; 273/193 A; 273/26 R

[58] Field of Search ..... 272/136, 137, 138, 139, 272/142, 143, DIG. 4, 67, 900; 273/26 B, 26 R, 29 A, 35 R, 191 B, 191 A, 191 R

[56] References Cited

U.S. PATENT DOCUMENTS

| | | | |
|---|---|---|---|
| 679,784 | 8/1901 | Ryan | 272/136 |
| 1,137,349 | 4/1915 | Patterson | 272/136 X |
| 2,134,451 | 10/1938 | Mogren | 273/26 R X |
| 3,592,467 | 7/1971 | Pereira | 272/137 |
| 3,618,942 | 11/1971 | Bates | 272/136 |
| 3,703,294 | 11/1972 | Fitch | 273/191 B |

FOREIGN PATENT DOCUMENTS

| | | | |
|---|---|---|---|
| 1421162 | 11/1965 | France | 272/900 |
| 6802124 | 8/1968 | Netherlands | 272/136 |

*Primary Examiner*—Richard C. Pinkham

*Assistant Examiner*—William R. Browne

*Attorney, Agent, or Firm*—John H. Calhoun, Jr.

[57] ABSTRACT

An apparatus for exercising and developing the muscles used in certain athletic endeavors comprising a plurality of elastic ropes, means for anchoring one end of each elastic rope to a stationary object, a plurality of handles made to conform in size, shape and construction to handles commonly used for golf clubs, baseball bats, tennis racquets and baseballs, and means for coupling the other ends of the elastic ropes to the aforesaid handles. To use the apparatus, a handle is coupled to one end of an elastic rope and the other end of the rope is anchored to a stationary object by a novel, fast and reliable means. Two or more ropes may be used in parallel if desired. The user then goes through the motions of swinging or throwing the handle forward in the manner customary for the particular sport. Forward movement of the handle is resisted by the elastic ropes which elongate as the applied force is increased. Repeated strokes with the handles against the resistance of the elastic ropes produces improvements in the strength and condition of the muscles used in the swinging or throwing motions.

3 Claims, 10 Drawing Figures

MULTI-SPORT EXERCISER

BACKGROUND OF THE INVENTION

This invention relates to exercising apparatus and more particularly to exercising apparatus intended to develop muscles that are used extensively in certain athletic endeavors such as golf, tennis or baseball. It is well known that in modern times large numbers of people lead sedentary lives and their normal day to day activities do not result in adequate physical exercise of physical work to assure good muscle tone. Many people engage in amateur athletic events of various kinds for entertainment or for health reasons or both, and professional athletes engage in athletic endeavors for profit as well. Greater benefits accrue to the athlete who performs well, and good performance results in part from exercising and developing the muscles most used in the endeavor.

Exercising apparatus of various kinds are known in the art, including apparatus intended to develop muscles used in specific sports. U.S. Pat. No. 1,137,349 issued on Apr. 27, 1915 to F. E. Patterson shows an exercising machine used to develop certain muscles used by golf players. The Patterson patent shows a golf club grip connected to one end of a cord that passes round a pulley and is connected at the other end to a spring loaded spool which is used for retracting and storing the cord when it is not under tension. U.S. Pat. No. 2,848,234 issued to T. O. Brandon on Apr. 19, 1958 shows a golf swing conditioner comprising an elastic rope connected at one end to a golf grip and at the other end by means of an eye screw or the like to a support member. U.S. Pat. No. 3,256,015 issued on June 14, 1966 to William E. Perrin shows an exercising apparatus for improving performance in various track and field events as well as other athletic events by increasing the muscle power of muscles used in such endeavors. U.S. Pat. No. 3,618,942 issued on Nov. 9, 1971 to Robert H. Bates shows a wrist and arm exercise device having a resiliant rope connected at one end to a bat or club and connected at the other end to a wall or other support.

SUMMARY OF THE INVENTION

My invention offers distinct and important improvements over exercising apparatus presently known in the art. One important object of my invention is to provide a multi-sport exerciser apparatus that can be conveniently used to exercise and develop the muscles used in more than one sport. Another object of my invention is to provide a multi-sport exerciser that can be used to exercise and develop more muscles than can be exercised and developed with exercise apparatus presently known in the art. Another object of my invention is to provide a multi-sport exerciser that can be quickly and easily changed from one form of exercise to another form of exercise such, for example, as changing from golf exercise to baseball exercise. Another object of my invention is to provide a multi-sport exerciser that can be quickly, easily and detachably anchored to almost any building without modifying the building in any way. Another object of my invention is to provide a multi-sport exerciser that is light weight and portable and can be conveniently carried in a suitcase and used in an office or in a hotel or motel room by people who are traveling away from their homes. Another object of my invention is to provide a multi-sport exerciser that is simple in construction and inexpensive to produce yet one that is durable and well suited for its intended purpose. Other objects and advantages of my invention will become apparent from a consideration of the following detailed description taken in connection with the accompanying drawings wherein a satisfactory embodiment of my invention is shown. It should be understood that my invention is not limited to the details disclosed but includes all such variations and modifications as fall within the spirit of the invention and the scope of the appended claims.

BRIEF DESCRIPTION OF THE DRAWINGS

Embodiments of my invention are illustrated in the accompanying drawings, in which.

DESCRIPTION OF THE PREFERRED EMBODIMENT

The multi-sport exerciser of the present invention comprises a plurality of handles that can be grasped in a person's hands, a plurality of elastic ropes made of rubber or other material capable of large plastic deformation, an anchor bracket, web strap and safety pin for anchoring the exerciser, coupling means for detachably coupling one end of each rope to one of the plurality of handles, and coupling means for detachably coupling the other end of each rope to the anchor bracket.

Figure 1A:
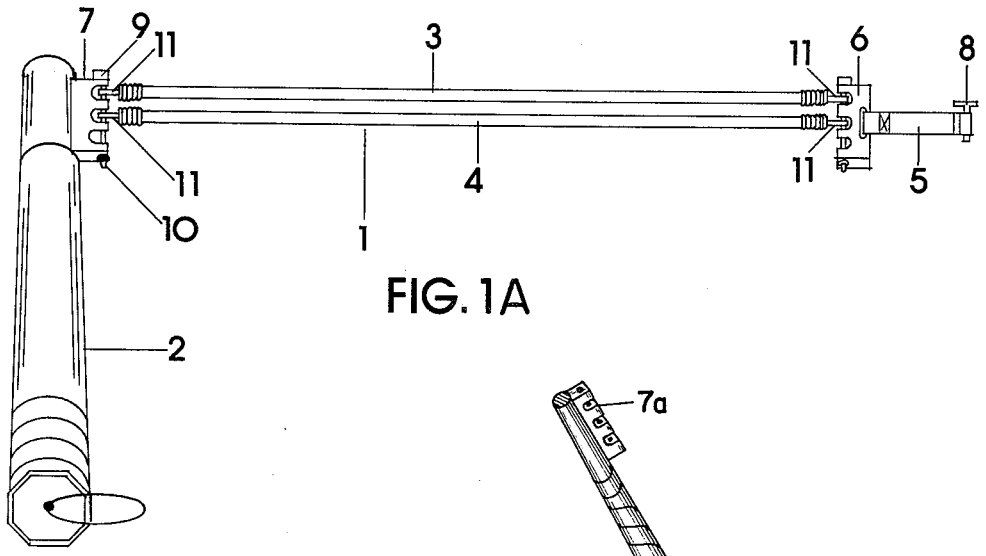
FIG. 1A is a perspective view of one embodiment of my invention assembled and ready for use with a tennis racquet handle.
Figure 1B:
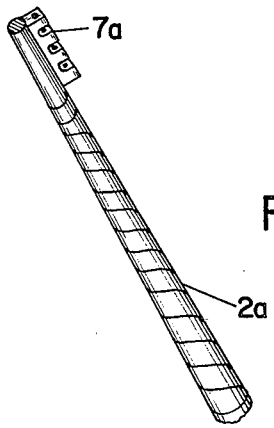
FIG. 1B shows a golf club handle.
Figure 9:
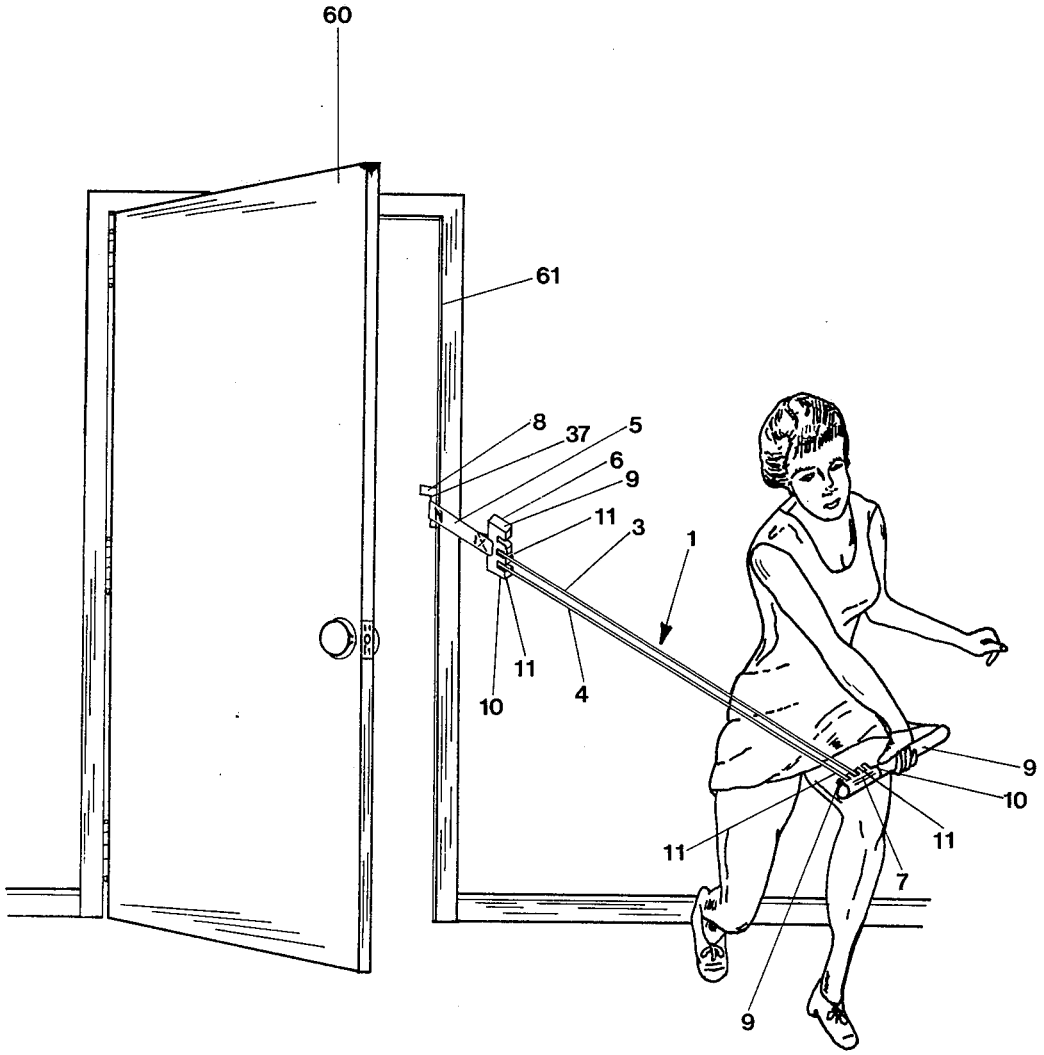
FIG. 9 is a view showing the position of the web strap and safety pin with respect to the surrounding structure.

Referring now to the drawings in greater detail, FIGS. 1A and 9 illustrate an embodiment of the invention assembled and ready for anchoring to a stationary object for use. The apparatus, shown generally at 1, comprises a handle 2 having the size, shape and construction of handles commonly used for tennis racquets, a plurality of elastic ropes 3, 4, a web strap 5, a detached anchor bracket 6, an attachment bracket 7, a safety pin 8, a plurality of connector pins 9, a plurality of grommets 10, and a plurality of ring connectors 11. FIGS. 1A and 9 show an embodiment of the invention with a tennis racquet handle 2, and FIG. 1B shows an alternate in the form of a golf club handle 2A.

The handle 2 may be constructed of wood, plastic, metal or other suitable materials, and the surface of the handle may be wrapped with leather, rubber, plastic cloth or other material to provide a slip-resistant grip.

Figure 2:
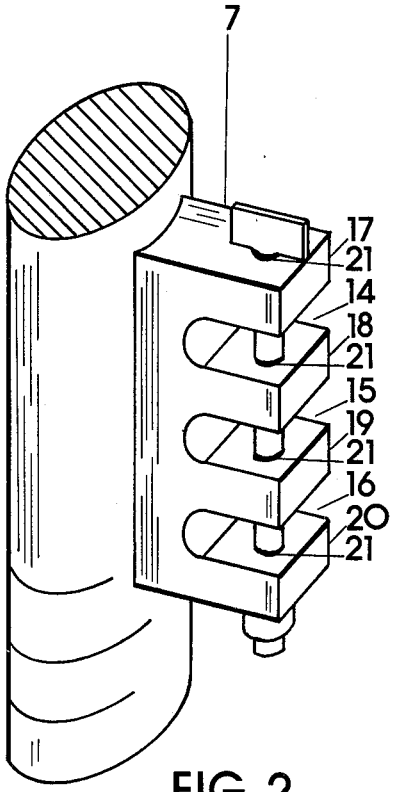
FIG. 2 is a perspective view of an attachment bracket.

FIG. 2 illustrates an attachment bracket 7 in greater detail. The attachment bracket 7 may be made an integral part of the handle 2 as shown in FIG. 2 or it may be produced as a separate piece and joined to the handle 2 by bolting, welding, adhesive bonding, or other suitable means. The attachment bracket 7 is essentially a flat rectangular member extending from the side of the handle 2 and having a plurality of attachment slots 14, 15, 16 formed by posts 17, 18, 19, 20. A hole 21 is provided in each post 17, 18, 19, 20, said holes 21 being in alignment with one another.

Figure 3:
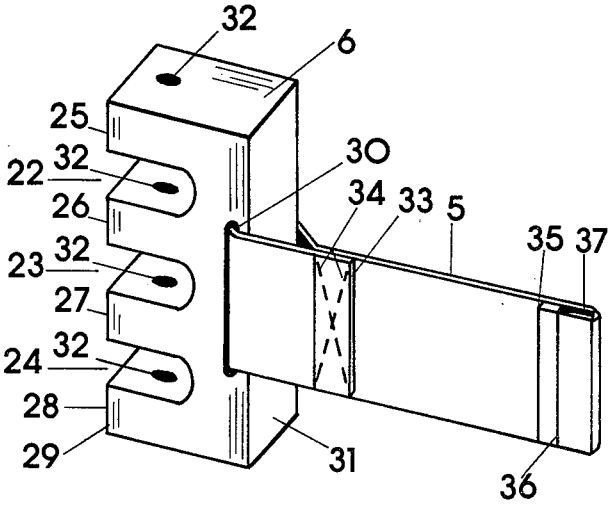
FIG. 3 is a perspective view of an anchor bracket and web strap assembly.

FIG. 3 illustrates an embodiment of a web strap 5 and detached anchor bracket 6. The anchor bracket 6 is shown as a solid rectangular piece having a plurality of slots 22, 23, 24 formed by posts 25, 26, 27, 28 along one edge 29 and a single and somewhat larger slotted hole 30 along the opposing edge 31. A hole 32 is provided in each post 25, 26, 27, 28, said holes 32 being in alignment with one another. One end 33 of a web strap 5 is looped through the hole 30 and is stitched at 34 to the strap 5 to form a permanent connection between the anchor bracket 6 and the web strap 5. The other end 35 of the web strap 5 is folded back onto the strap 5 and is stitched at 36 to form a slot 37 in the end of the strap 5. The anchor bracket 6 may be made of metal, plastic or other material having adequate strength properties and the web strap 5 may be made of nylon or other strong and flexible material.

Figure 4:
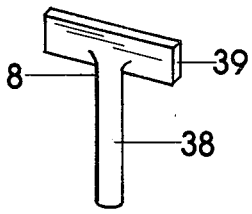
FIG. 4 is a perspective view of a safety pin.

FIG. 4 illustrates a safety pin 8 which, in the illustrated embodiment, comprises a solid "T"-shaped member made from solid metal rod stock. The shaft 38 of the safety pin 8 is adapted to fit snugly in the slot 37 in the web strap 5, and the crossbar 39 is adapted to conveniently fit into a person's hand for insertion of the safety pin 8 into or removal of the safety pin 8 from the slot 37.

Figure 5:
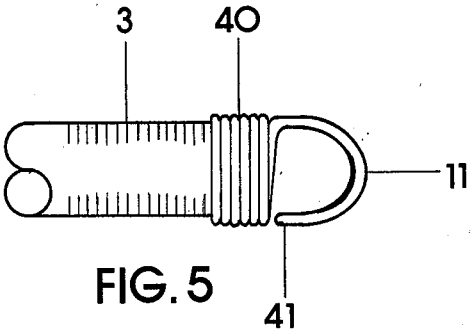
FIG. 5 is a plan view of a ring connector.

FIG. 5 illustrates a ring connector 11 which is formed from high strength wire or rod stock. A strong metallic wire or rod is wrapped tightly around an elastic rope 3 at 40 and one end 41 of the wire or rod is bent to form a ring 11. A ring 11 is thus provided at each end of each elastic rope 3, 4.

Figure 6:
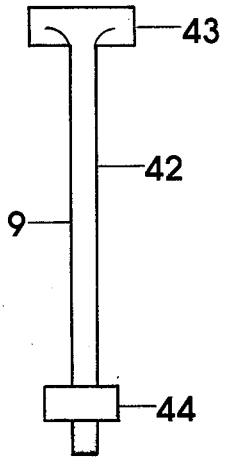
FIG. 6 is a front elevation view of a connector pin and grommet.

FIG. 6 illustrates a connector pin 9 having a shaft 42 and head 43. The plurality of pins 9 are made from steel or other suitable strong material and the shafts 42 thereof are adapted to fit neatly into the holes 21, 30 in the attachment bracket 7 and anchor bracket 6 respectively. A tight fitting grommet 44 made of rubber or other resilient material is provided for each connector pin 9.

Figure 7:
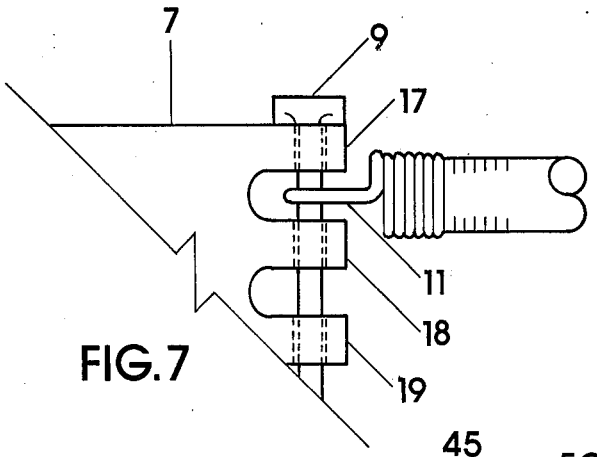
FIG. 7 is a fragmentary front elevation view of an attachment bracket connection to a ring connector.

As shown in FIG. 7, a ring connector 11 attached to one end of an elastic rope 3, 4 is inserted into a slot 14 in an attachment bracket 7 and a connector pin 9 is inserted into the holes 21 and through the ring connector 11 to detachably couple one end of an elastic rope 3, 4 to the handle 2 at slot 14. The head 43 of the connector pin 9 is seated against the bracket 7 and a grommet 10 is placed over the other end of the pin 9 to prevent the pin 9 from slipping out of the holes 21. The other end of the elastic rope 3, 4 is detachably coupled to the anchor bracket 6 by inserting the ring connector at that end into a slot 22, 23, 24 and securing the ring 11 within the slot 22, 23, 24 with a connector pin 9 and grommet 10.

The safety pin 8 is inserted into the slot 37. FIG. 9 illustrates a partly opened door 60 to any room in any building and the web strap 5 with the safety pin 8 inserted in the slot 37 thereof is placed between the door 60 and the door frame 61 on a side of the door with the shaft 38 of the safety pin 8 in a vertical position with the crossbar at the top or between the door and the door frame at the top of the door so that the slot 37 in the web strap 5 and the safety pin 8 are on one side of the door and the anchor bracket 6 is on the other side of the door. The door is then closed to securely anchor one end of my multi-sport exerciser to the building. The apparatus, thus assembled and anchored, is ready for use. To use the apparatus, the user grasps the handle 2 in his or her hand and adjusts his or her position relative to the door to obtain the desired amount of tension on the elastic rope. The user then swings the handle forward in the manner used by tennis players. The elastic rope resists the forward movement of the handle thus requiring the user to grip the handle tightly and to swing with greater force than would be required in playing an actual game of tennis, thereby strengthing the muscles in the hand, wrist and arm. Exercise conditions may be changed by raising or lowering the position of the web strap along the side of the door, by anchoring the multi-sport exerciser to the top rather than to the side of a door, by adding or removing one or more elastic ropes, by selecting a slot 14, 15, 16 to give the desired amount of leverage, or by adjusting the user's position relative to the door.

Figure 8:
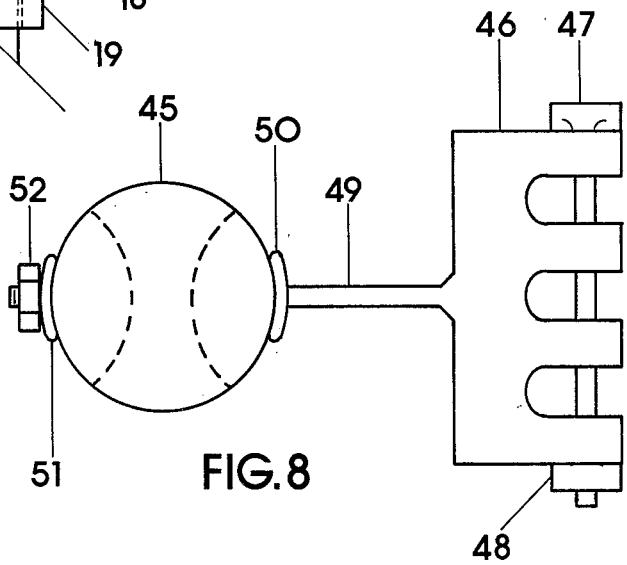
FIG. 8 is a front elevation view of an alternate embodiment of a handle and attachment bracket assembly.

In alternate embodiments of my invention a handle 2 is provided having the size, shape and construction of a golf club handle or the size, shape and construction of the handle end of a baseball bat. The alternate embodiments of my invention are assembled and anchored in the same manner as the illustrated embodiment, however the handle 2 is grasped in both hands by the user and is swung in the manner customary for hitting a golf ball with a golf club or in the same manner customary for hitting a baseball with a baseball bat. FIG. 8 illustrates yet another embodiment of my invention in which a handle 45 is provided having the size, shape and construction of a baseball. The handle 45 is provided with an attachment bracket 46, a connector pin 47 and grommet 48 of the kind illustrated herein. A rod 49 having a flange 50 is attached at one end to the bracket 46 and passes through the handle 45. A washer 51 and nut 52 secure the rod 49 to the handle 45. One end of an elastic rope 3, 4 is detachably coupled to the bracket 46 and the other end is detachably coupled to the anchor bracket 6 in the manner described herein. The last described embodiment of my invention may be used to exercise and develop muscles used to throw a baseball.

As can be easily seen, my multi-sport exerciser can be readily used to exercise and develop the muscles used in more than one sport and can be used to exercise and develop more muscles than can be exercised and developed by exercise apparatus presently known in the art. My multi-sport exerciser may be disassembled and carried in a brief case or suit case, and it can be quickly and easily assembled and detachably anchored to almost any building without modifying the building in any way and can be changed from one form of exercise to another in a few seconds.

Having thus described my invention, I claim:

1. A multi-sport exerciser apparatus comprising a plurality of handles each of which is adapted to be grasped in a person's hand and is adapted to be detachably coupled to a plurality of elastic ropes, a plurality of elastic ropes each of which has two ends wherein one end is adapted to be detachably coupled to any of the plurality of handles and the other end is adapted to be detachably coupled to an anchor bracket, a detached anchor bracket adapted to receive any of the aforesaid plurality of elastic ropes detachably coupled thereto and having a web strap attached thereto which web strap is adapted to detachably couple the aforesaid anchor bracket to a building, said web strap having two ends wherein one end is attached to the anchor bracket and the other end is provided with slot means adapted to receive a safety pin removably and slidably inserted therein, said strap being adapted to be detachably coupled to a building by inserting the said strap between an open door of said building and its frame with one of the ends of said strap on one side of the said door and the other of the said ends on the opposite side of the said door and closing the said door; a safety pin having a crossbar at one end thereof and adapted to be removably and slidably inserted into the slot means in the web strap and adapted to prevent the strap and pin from coming through an opening between a closed door and its frame when the said safety pin is positioned on one side of the said closed door and tension is applied to the other end of the said web strap from the other side of the said closed door, a first coupling means for detachably coupling one end of any of the plurality of elastic ropes to any of the plurality of handles, and a second coupling means for detachably coupling the other end of any of the plurality of elastic ropes to the detached anchor bracket.

2. A multi-sport exerciser apparatus comprising a plurality of handles having the sizes, shapes and constructions of articles of athletic equipment and each of which is provided at one end with an attachment bracket extending outward therefrom and comprising a rectangular member having a plurality of slots along one edge thereof formed by a plurality of outward extending posts and adapted to receive a plurality of ring connectors removably inserted therein, said posts having a plurality of holes provided therein which holes are in alignment with one another and are adapted to receive a connector pin removably inserted therein; a plurality of elastic ropes each of which is provided at each end with a ring connector permanently connected thereto; an anchor bracket comprising a rectangular member having a plurality of slots along one edge thereof formed by a plurality of outward extending posts and adapted to receive a plurality of ring connectors removably inserted therein, said posts having a plurality of holes provided therein which holes are in alignment with one another and are adapted to receive a connector pin removably inserted therein and a slotted hole along the opposing edge thereof adapted to receive a web strap inserted therethrough; a web strap having one end thereof inserted through the aforesaid slotted hole in the anchor bracket and folded back onto the said web strap and stitched thereto to form a permanent connection of the said web strap to the said anchor bracket and folded and stitched at the other end to form a slot adapted to receive a safety pin removably and slidably inserted therein and adapted to be detachably coupled to a building by inserting the said strap between an open door of a building and its frame and closing a door; a safety pin having a crossbar at one end and adapted to be removably inserted into the aforesaid slot in the aforesaid web strap and adapted to prevent the web strap and said safety pin from coming through an opening between a closed door and its frame when the said safety pin is positioned on one side of the said closed door and tension is applied to the said strap through the said anchor bracket from the other side of the said closed door; coupling means for detachably coupling one end of any of the plurality of elastic ropes to any of the plurality of handles comprising a connector pin having a head at one end and adapted to be removably inserted into the holes in the posts on the attachment brackets and through the ring connectors and a grommet made of resilient material and adapted to fit tightly over the other end of the connector pin; and coupling means for coupling the other end of any one of the plurality of elastic ropes to the anchor bracket comprising a connector pin having a head at one end and adapted to be removably inserted into the plurality of holes in the plurality of posts on the anchor bracket and a grommet made of resilient material and adapted to fit tightly over the other end of the connector pin.

3. The multi-sport exerciser apparatus of claim 2 wherein a handle is provided having the size, shape and construction of a baseball and wherein the said attachment bracket is removably coupled to the said handle by a rod threaded at one end and having a flange integral therewith and that is joined at the other end to the said attachment bracket and passes through the said handle with the said flange seated against one side of the said handle and a curved washer and nut for securing the said rod to the said handle.

* * * * *